US010174462B2

(12) United States Patent
Rangoni

(10) Patent No.: US 10,174,462 B2
(45) Date of Patent: Jan. 8, 2019

(54) METHOD FOR WATERPROOFING RAILWAY BRIDGES AND WATERPROOFING MATERIAL FOR CARRYING OUT SAID METHOD

(71) Applicant: Christiano Rangoni, Bologna (IT)

(72) Inventor: Christiano Rangoni, Bologna (IT)

( * ) Notice: Subject to any disclaimer, the term of this patent is extended or adjusted under 35 U.S.C. 154(b) by 224 days.

(21) Appl. No.: 15/115,164

(22) PCT Filed: Jan. 28, 2015

(86) PCT No.: PCT/IB2015/050649
§ 371 (c)(1),
(2) Date: Jul. 28, 2016

(87) PCT Pub. No.: WO2015/114537
PCT Pub. Date: Aug. 6, 2015

(65) Prior Publication Data

US 2016/0348322 A1 Dec. 1, 2016

(30) Foreign Application Priority Data

Jan. 28, 2014 (IT) ..... BO2014A0034

(51) Int. Cl.
*E01B 2/00* (2006.01)
*E01D 4/00* (2006.01)
(Continued)

(52) U.S. Cl.
CPC ..... *E01B 37/00* (2013.01); *E01B 2/003* (2013.01); *E01B 27/04* (2013.01); *E01D 4/00* (2013.01);
(Continued)

(58) Field of Classification Search
CPC . E01B 37/00; E01B 2/00; E01B 2/003; E01B 27/04; E01D 4/00; E01D 19/083; E01D 22/00; E01D 2204/07
See application file for complete search history.

(56) References Cited

U.S. PATENT DOCUMENTS 4,366,846 A * 1/1983 Curati, Jr. ..... E01B 19/006 141/1
4,388,357 A * 6/1983 Luebke ..... E01B 1/008 210/170.09
2016/0348322 A1* 12/2016 Rangoni ..... E01B 2/003

FOREIGN PATENT DOCUMENTS

GB 2 258 874 A 2/1993
GB 2258874 A * 2/1993 ..... E01B 2/006

OTHER PUBLICATIONS

International Search Report dated May 28, 2015, International application No. PCT/IB2015/050649, 2 pages.

* cited by examiner

*Primary Examiner* — Jason C Smith
(74) *Attorney, Agent, or Firm* — Ware, Fressola, Maguire & Barber LLP

(57) ABSTRACT

A method for waterproofing of bridges (1) and similar structures aimed at railway traffic is described, the structures comprising an arch or deck structure, on which there is placed a ballast (M) of gravel or crushed stone (2) upon which the tracks (6) extend between the two ends of the bridge (1). The waterproofing is obtained first by the removal of the tracks (6) and a reduced layer (S) of gravel or crushed stone (2), leaving in place the remaining part of gravel or crushed stone (2), and then by laying one or more sheets (10) of cured rubber on the remaining part of gravel or crushed stone (2). The thickness of the rubber is such as to be sufficiently resistant to perforation by the gravel or
(Continued)

crushed stone (2), which is subsequently placed thereon to complete the ballast, Finally, the previously removed tracks (6) are set in place again. According to the method, a joint is made between the sheets (10) by means of a connection of mechanical type, with a positive locking shape fit, or a chemical bond using a suitable adhesive.

9 Claims, 10 Drawing Sheets

(51) Int. Cl.

| | |
|---|---|
| ***E01B 27/04*** | (2006.01) |
| ***E01B 37/00*** | (2006.01) |
| ***E01D 19/08*** | (2006.01) |
| ***E01D 22/00*** | (2006.01) |

(52) U.S. Cl.
CPC ..... *E01D 19/083* (2013.01); *E01D 22/00* (2013.01); *E01B 2204/07* (2013.01)

KNOWN ART

METHOD FOR WATERPROOFING RAILWAY BRIDGES AND WATERPROOFING MATERIAL FOR CARRYING OUT SAID METHOD

TECHNICAL FIELD

The present invention refers to the construction and maintenance of infrastructures, in general, with reference to the railway field. In particular, the present invention refers to the maintenance of existing railway bridges. In practice, the invention aims at proposing a new method for waterproofing of the above mentioned bridges, which is more efficacious, economic and rapid to apply with respect to the actually available and implemented ones.

BACKGROUND ART

The National Railway Network, like in many other European and extra-European countries, is well developed in the territory in a capillary way. Our territory has a particularly varied distribution of mountain ranges, which has caused the construction of numerous bridges and viaducts.

Among the most frequent types of bridges there are arch bridges (see FIG. 1), with one or more spans, generally masonry bridges or bridges of reinforced concrete, and those with decks are made with a mixed structure of steel and concrete, that is of reinforced concrete. The drawings do not report bridges with decks, however, the considerations made in relation to the arch bridges are valid also for the bridges with decks, if not otherwise specified.

Although many of the actually used bridges were built and operated many years ago (many of them date back to before the second world war), they are kept in static conditions sufficient to ensure the safety of trains passing on them, in spite of the present railway traffic.

TECHNICAL PROBLEM

However, the arch bridges and deck bridges are often troubled by the state of general maintenance, often characterized by conditions of strong deterioration of materials and structural elements they are made of. These problems of the maintenance conditions manifest themselves as broken bricks, corroded reinforcements, washed away mortars, crumbled concrete, etc. In most cases, the above mentioned deterioration conditions can be traced back to only one cause, that is the infiltration and stagnation of rainwater, due to the loss of efficiency of the waterproofing system and separation of rainwater.

In detail, as it is well known to those skilled in the art, over the supporting structure of any bridge 1, there is a ballast M, made of gravel or crushed stone 2 of big dimensions, accumulated between the opposite containment walls 3, 4. Such a structure can be obviously recognized in FIG. 2, which refers to the known waterproofing technique that will be described now. The railway ties 5, to which the tracks 6 will be fastened, are arranged deep in the gravel or crushed stone 2. A waterproof sheath 7 is arranged between the ballast and the supporting structure of the bridge. Some time ago the sheath was made of a membrane composed of cast bitumen and sand, cast in place during the construction of the bridge 1 or during the extraordinary maintenance operations.

In more recent operations, the bitumen is applied by a spraying machine (not shown in the Figure). A sheet of nonwoven fabric (likewise not shown) is then applied over the layer of bitumen. This allows acting over the first layer of bitumen without getting stuck with it, as it would be obvious otherwise. Then the spraying machine carries out a second coat applying another layer of bitumen.

An alternative version, not shown, includes the use of prefabricated bituminous membranes, made in rolls and laid out one beside another, with suitable overlaying borders welded in place.

In brief, until the seventies, the works were done using cast bitumen and sand, passing, up to present times, to the use of prefabricated fibre-reinforced bituminous membranes (still used nowadays in the construction of new bridges). In the last years, from about 2010 on, bituminous membranes made in place are used (bitumen+TNT+bitumen), which is a very effective solution, but feasible only on particularly wide surfaces, due to the necessity to spread very hot bitumen, by means of a tanker heated to 160°-180° C.

For works in areas of a certain extension, however, the application of the sheaths made in place has been recently used again, with bitumens of new generation reinforced with the inclusion of special fabrics.

In any case, due to the not appropriate resistance to the stresses transmitted by the crushed stone situated above and constituting the ballast, the bitumen sheath must be covered with a protection layer 8, sometimes made of concrete, reinforced if necessary and, on the other hand, in other cases, more often, of bituminous conglomerate.

On the other hand, for the same reasons, the sheath 7 must be placed on a rigid support 9, which in the bridges with decks is constituted by the slab of reinforced concrete, whereas in the arch bridges is made by the shoulder of the arch, in general of concrete.

Giving a right inclination to the support 9 of the sheath and consequently, to the same sheath 7, the rainwater intercepted thereby at the base of the ballast M is conveyed out of the bridge and discharged below it.

This traditional system, of simple and immediate application, presents however a number of drawbacks, which determine in fact the loss of efficiency of the waterproofing system as a whole.

A first drawback is an insufficient duration of the service life of the layer of the waterproofing bitumen. Statistically, it has been noticed that in 20-30 years from their production, the so formed sheaths gradually lose their functionality.

This happens either due to the loss of the material elasticity or due to the possible breaking of the protective layer, as well as due to the possible excessive movements of the support and possible accidental damages caused by the works on the railway line.

Substantially, the rainwater falling on the railway line penetrates the collection barrier, which is no longer effective and consequently does not prevent infiltrations, instead of being intercepted and collected by the waterproofing system to be later conveyed by means of a drainage network and removal system.

After having overcome the barrier, normally formed by a layer of bitumen, the water reaches the structural parts of the bridge and spreads and stagnates between the various elements with all the resulting problems.

The deterioration conditions that are triggered by the water, do not progress regularly over time, but manifest an exponential progression, becoming rapidly evident only in already irreparable conditions, which threaten to jeopardize or jeopardize the bridge safety. At this point, the bridge repair cannot be avoided any more and the costs as well as the consequences on the railway services are usually heavy.

Moreover, the intensification of the railway traffic causes negative effects due to two substantial reasons. First of all, higher frequency of trains transiting on the section of railway line along the bridge, contributes to more rapid damage of the waterproofing means, thus accelerating the bridge deterioration. Secondly, the higher frequency of passages and the stronger needs to respect timetables and to optimize the use of the rolling stock, make it more difficult to plan and carry out the maintenance operations.

Taking into consideration that the average life of a bridge can easily reach 80-100 years and even more, it is clear that in order to achieve such long life, the waterproofing system of each bridge must be reconstructed even more times during its operational life.

However, this operation is not easy to carry out and is hindered, if not even prevented by the only possible executive modes of the operation, which constitute a second drawback of the traditional waterproofing systems. Actually, in order to carry out waterproofing again, it is necessary to decommission the railway line for a sufficiently long period of time, that is 3 to 4 days for smaller bridges, but for longer periods of time, up to 10 days for the longer bridges. In fact, it is necessary to dismount the tracks, remove completely the gravel 2 of the ballast M, cast again the bitumen 7, spread the protective layer of concrete or asphalt and reposition the ballast and tracks.

The removal of the gravel or crushed stone 2 that composes the ballast does not involve only a small thickness thereof, but is radical, up to the supporting structure, thus causing non negligible difficulties and especially spending a lot of time.

However, long times are caused also by the fact that the concrete and bitumen used to place the impermeable layer and to protect it, need technical times for setting and hardening, which can prolong for days and also after the repositioning of the railway line.

Consequently, the restoring of suitable waterproofing conditions with the traditional systems is extremely difficult and in some cases impossible, due to the necessary times, which cause too long interruptions of service, in fact, impracticable on the busiest lines.

In any case, even a regular maintenance of the bridge does not resolve the problem, since it does not eliminate the reason of its decay, resulting from a progressive inefficiency of the waterproofing system. Once the maintenance operation has been completed, the deterioration situation that has made it necessary, will repeat in a short time.

The problems pointed out in the introductory note become extremely important if their extension is considered, since, for example in Italy there are about ten thousands bridges in these conditions.

A method conceived some time ago provides the use of a suitable machine for maintenance of tracks, mounted on a train and modified so that, moving on the bridge, it resets the waterproofing system. In detail, the machine raises the track and removes the crushed stone situated under it along the section in which it has been raised. Then the method provides manual introduction of sheets of nonwoven fabric, having suitable solidity and thickness and on these sheets of fabric a traditional sheath is made, of the prefabricated bituminous type or of epoxy type made by spraying technique. Subsequently, other sheets of nonwoven fabric are applied and finally the machine arranges again the crushed stone and tracks.

Although this gives a solution as far as the implementation times are concerned, however, this method does not allow to obtain satisfying efficiency results, also because the operation is carried out on one track at a time, thus on a limited width of the railway line, making it necessary to reconstruct the continuity between the waterproofing layers in different moments, so as to prevent the infiltrations which would occur in any case.

Another waterproofing method, which can be applied to railway bridges and known from the British Patent Application no. GB 2 258 874, includes the injection, below the tracks, of a liquid material, capable of polymerizing and creating an impermeable mass.

However, this method involves a series of drawbacks, even quite obvious and is not used in practice. This mass, which is impervious in itself, usually includes a part of the ballast and cannot become a continuous covering that ensures total waterproofing. Neither a sufficiently accurate application at the sides of the ballast can be assured, so that the water could penetrate sideways. Moreover, the liquid must be injected forcefully with subsequent applications at distances from one another. In this way, giving assurance that the application will not be a fragmented patchwork, thus thwarting the whole work, is practically impossible. Furthermore, the mechanical resistance of the mass to the continuous stresses deriving from the passage of trains is not assured on the medium-long term.

The U.S. Pat. No. 4,366,846 describes a system for the containment and collection of liquids, for example, produced from petroleum, which can be applied to a section of railway line. The system comprises, among other things, a layer of waterproof material spread under the ballast, in contact with the solid sublayer.

Although the technical problem tackled by the aforesaid document can be partially traced back to that of the present invention, the solution proposed by the document is included among the conventional ones as described above. In fact, in order to implement the system proposed by the above mentioned patent, the ballast must be completely removed, therefore, the problem of the mechanical resistance in respect of the combined action exerted by the crushed stone forming the same ballast from above and from below, especially during the passage of trains and in the long run, is not encountered.

The document U.S. Pat. No. 4,388,357 describes likewise a system of waterproofed containment, aimed at collecting oil products, etc., which can be applied to a railway line. As far as waterproofing aspects are concerned, the characteristics of the proposed solution are substantially the same as those proposed by the present document, as well as the drawbacks resulting therefrom.

OBJECTS OF THE INVENTION

Therefore, the object of the present invention is to propose a different method for waterproofing bridges, which is rapid to carry out and effective in its functionality, but which can first of all stop any progressive deterioration of the bridges allowing subsequent renewal operations.

In substance, the proposed method must be quick in the implementation of the waterproofing system; in addition, it must require low costs of the used materials and the implementation as a whole.

Another requirement of the proposed method is the system adaptability to different types of bridges and to different geometries.

Finally, a suitable durability is required, especially with respect to the costs and installation expenses.

As it can be deduced from claim 1, in a first aspect the above mentioned method means to resolve this technical problem by relying on only one element with both sheath, waterproofing function and protection and support functions; in a second aspect, the method aims at allowing a dry installation, which does not need times for setting or hardening of the materials being used.

The invention is also aimed at protecting a material for waterproofing the above mentioned bridges, according to the contents of the claims.

BRIEF DESCRIPTION OF THE DRAWINGS

The characteristics of the invention, which have not appeared from what has been previously said, will become evident from the following description, with reference to the enclosed drawing tables, in which.

DESCRIPTION OF PREFERRED EMBODIMENTS OF THE INVENTION

Figure 1:
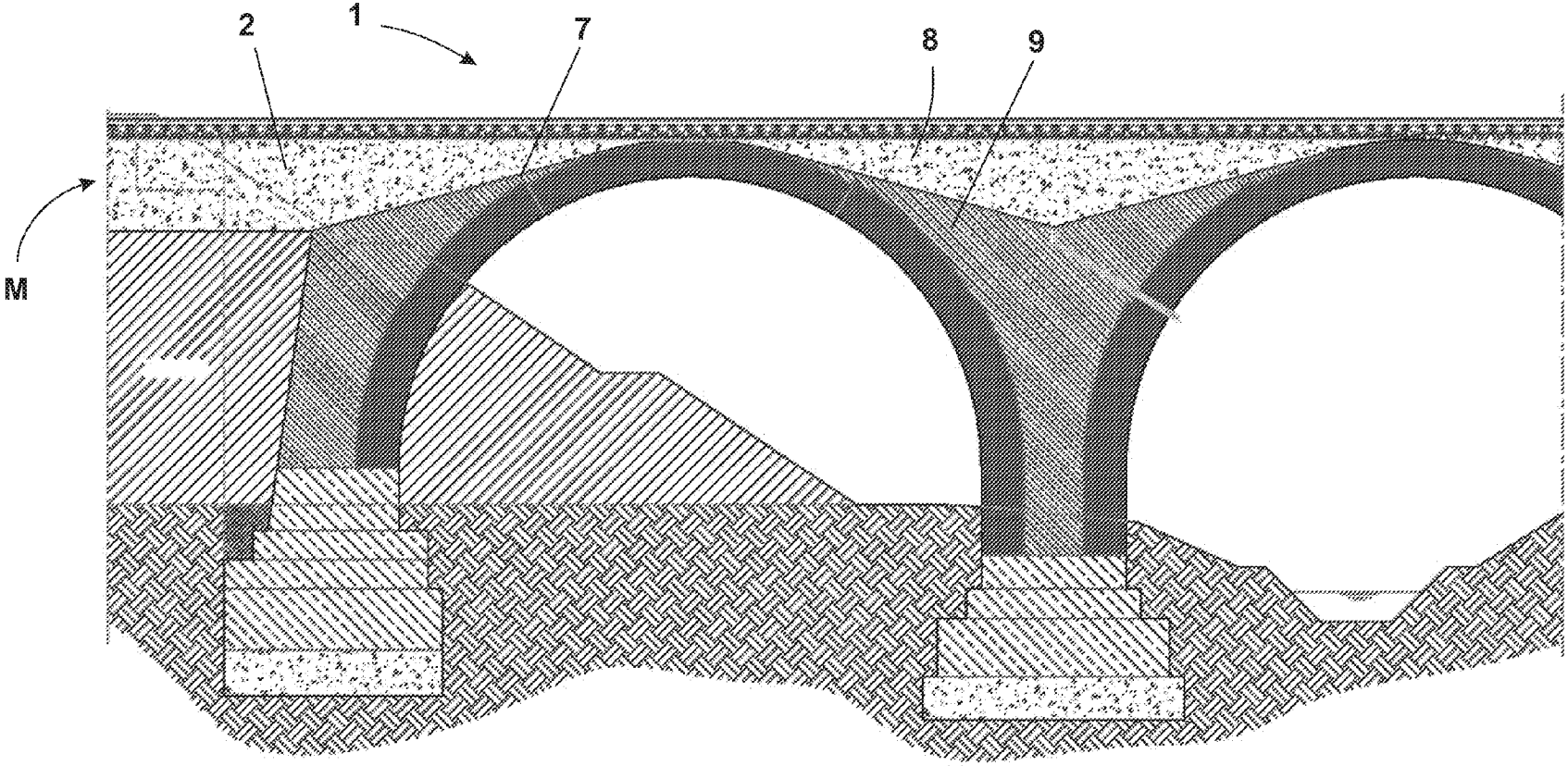
FIG. 1 and FIG. 2 show an arch bridge and the conformation of the waterproofing system according to the traditional modality of the prior art, in lateral and top views, respectively, with some parts removed so as to better point out the implementation of the waterproofing system according to the prior art.
Figure 2:
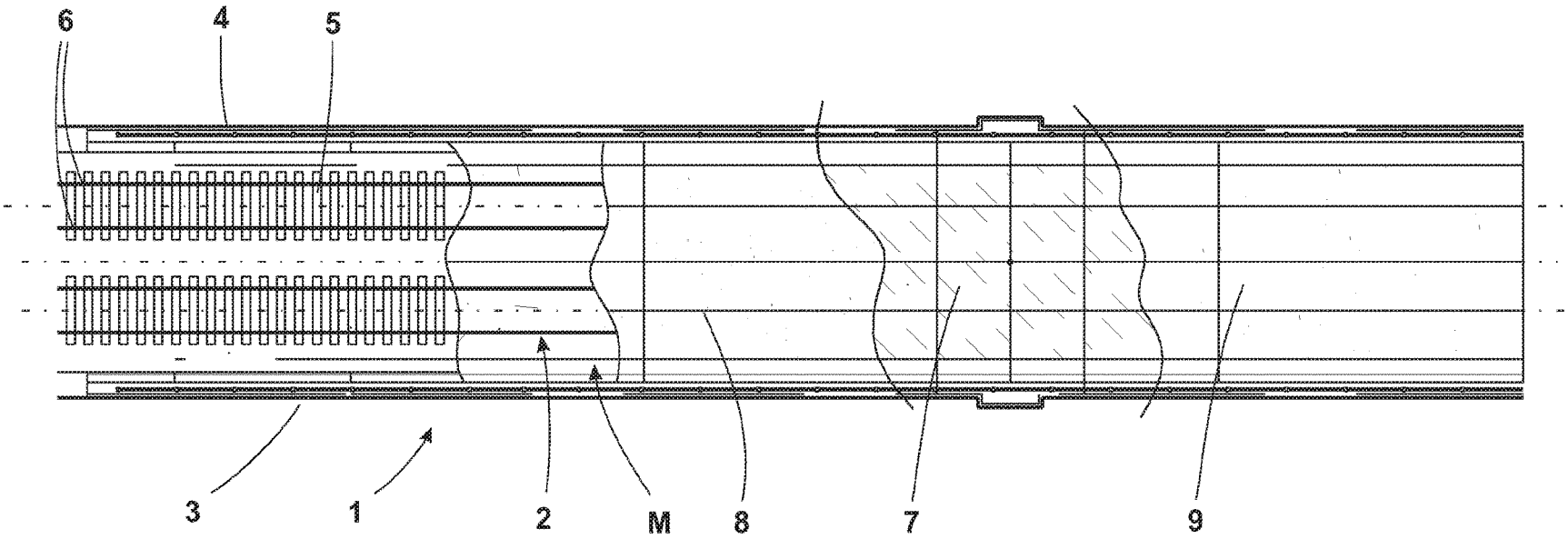

With reference to the above mentioned Figures, reference numeral 1 indicates, by way of example, an arch bridge (FIG. 3), which has been subjected to maintenance to restore the waterproofing system. As already said, the considerations made for an arch bridge will be valid also for the bridges with decks, if not otherwise specified.

In accordance with the method proposed by the present invention, the operation on the track can be advantageously carried out in automatic way, by the machines already used for alignment (not shown in the drawings).

Figure 3:
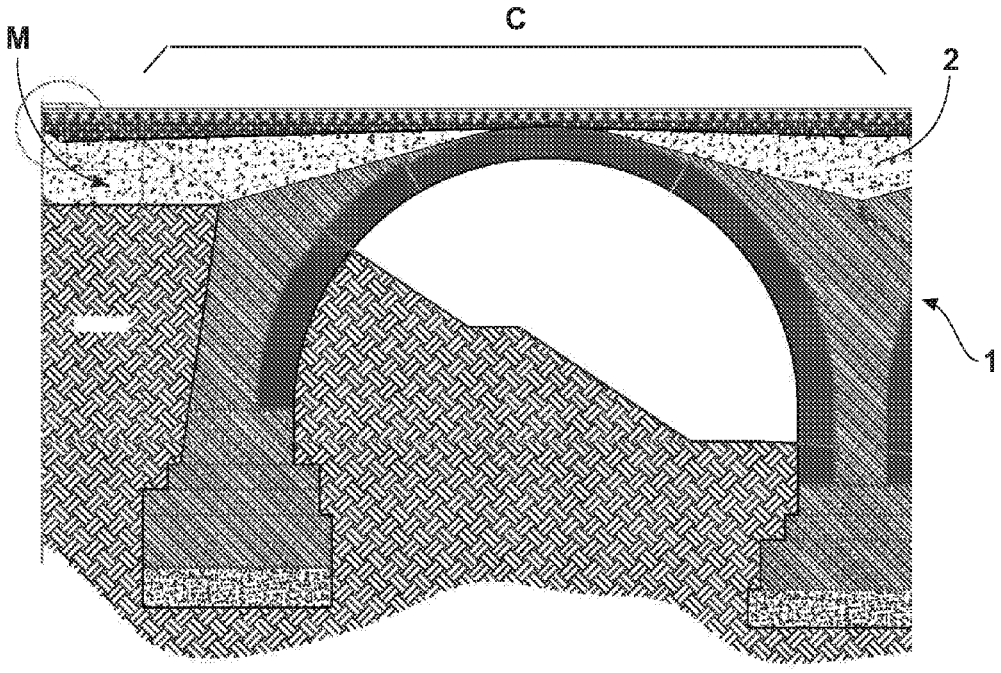
FIGS. 3 and 4 show an arch bridge and the conformation of the waterproofing system according to the invention, with the bridge seen from the side and in cross section, respectively.
Figure 5:
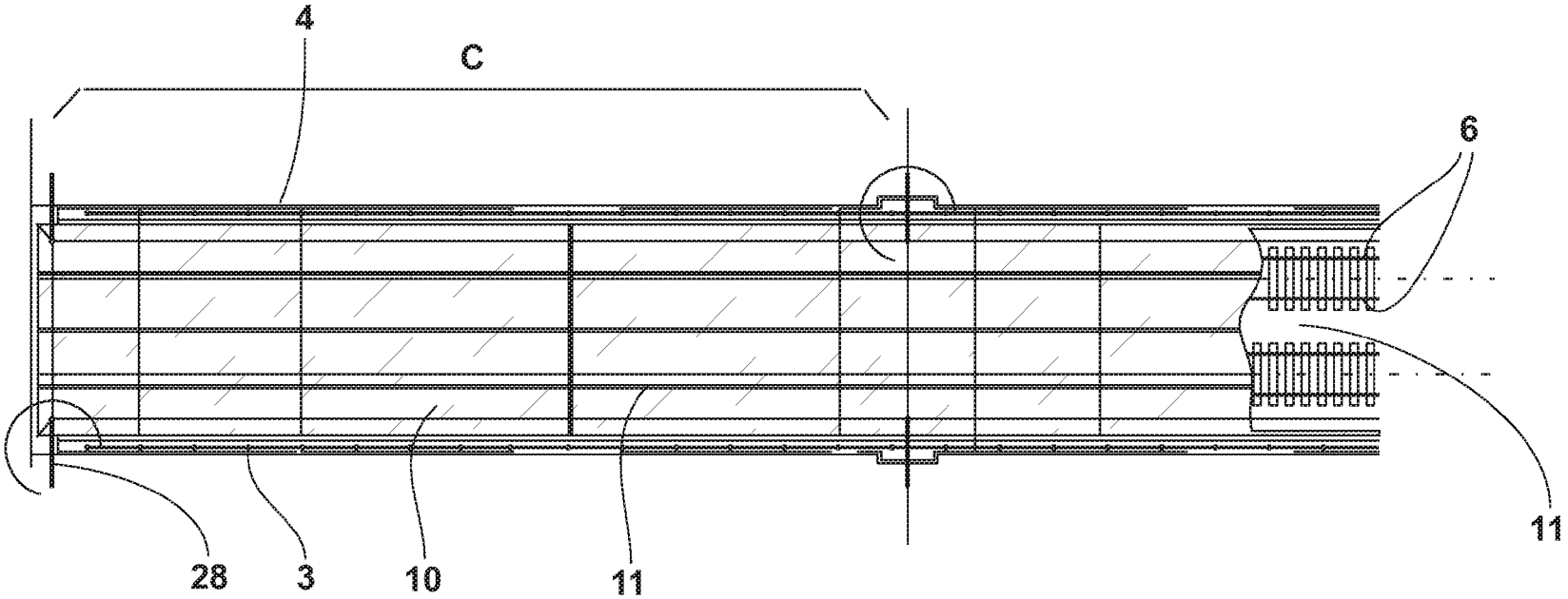
FIG. 5 shows the bridge of FIGS. 3 and 4 in plan view, with some parts removed to better point out the implementation of the waterproofing system proposed by the present invention.

First the tracks 6 are sectioned in pieces of 18-20 meters by cutting with oxyacetylene torch, along each span C of the bridge 1 (FIGS. 3 and 5).

Then, the tracks are moved to the side, in an area which is not involved in the restoration; the tracks are moved by a machine called loading platform. The loading platform, which lifts, and a mechanical shovel, which shifts and moves away, remove a layer of crushed stone 2 to the extent necessary for the method under discussion. Such extent exceeds a little the depth of the layer normally removed for the ordinary maintenance of the tracks, but not more than that. The removal depths typically acceptable are comprised between 50 and 80 centimetres.

Afterwards, the material of cured rubber in sheets 10 is laid in one layer, without any concrete support layer or covering/protection layer of bitumen conglomerate.

The quality of the used rubber, which includes a particular compound, prepared on purpose to give resistance to the perforation, relieves from the necessity of using concrete support levels below and layers of bituminous conglomerate above, since it is self-protected and avoids perforations, tearing, cracks, etc.

This allows the maintenance operation with the restoration of the waterproofing system to be carried out in few hours for those bridges for which the traditional system required a few days.

Since the crushed stone 2 has rather irregular forms, it is to be expected that the rubber must adapt itself assuming shapes that correspond to the shapes of the crushed stone lying thereon and to the shapes of the crushed stone situated under it.

Figure 6A:
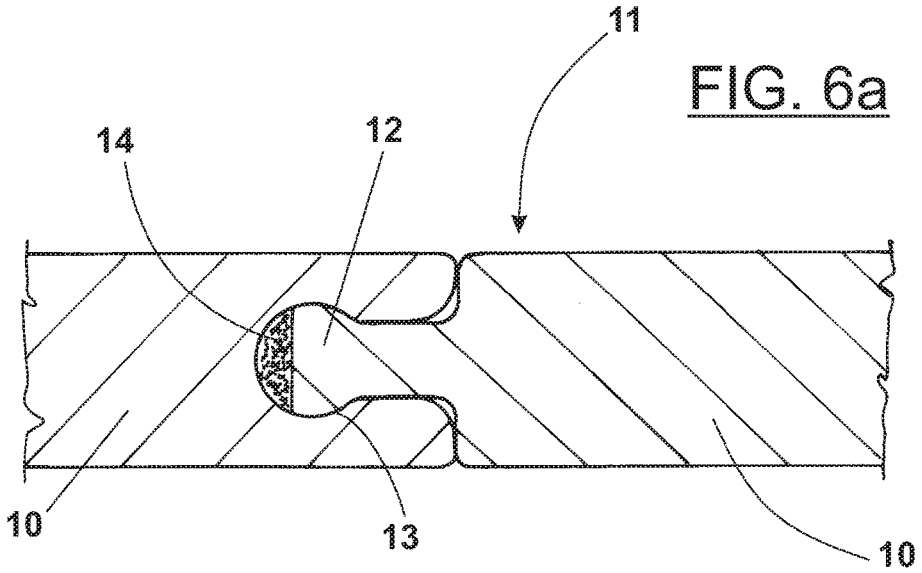
FIGS. 6A to 6C illustrate the details, in section view, of a characteristic point of the waterproofing system proposed by the present invention.
Figure 6B:
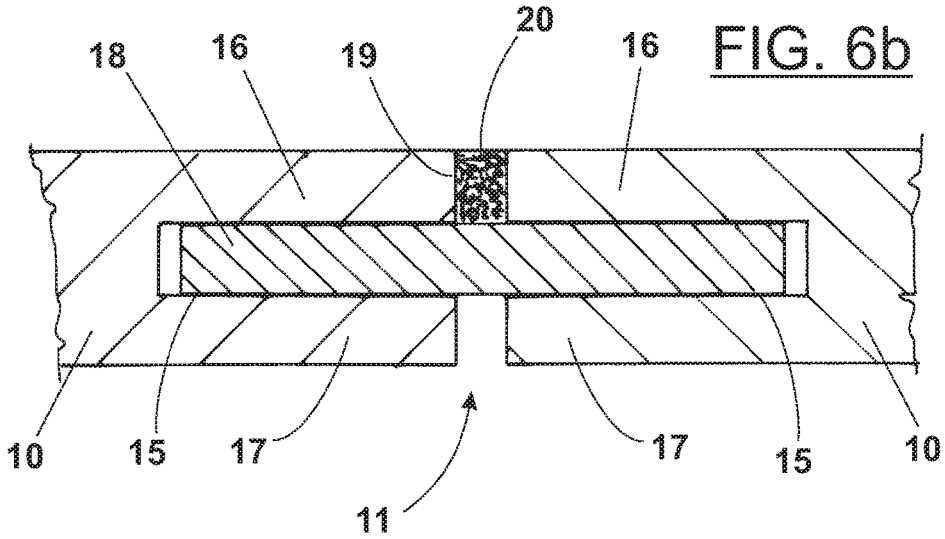
Figure 6C:
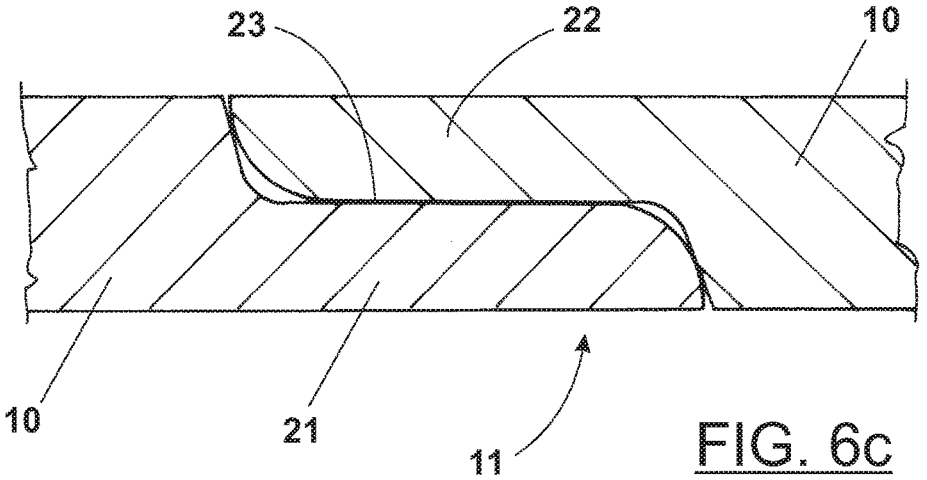

With reference to FIGS. 6A-6C, the joint 11 between the various sheets 10 is made without using glues or adhesives and this also helps save time for the restoration of the waterproofing system. In fact, the sheets 10 are separated and, in case, pre-assembled in the material production site or in another specially provided place, and then put in place by unrolling them from rolls (not shown), on which they have been previously rolled up to be transported.

If the transversal and longitudinal dimensions of the bridge do not allow reasonably the assembly, transport and subsequent laying of a single sheet, smaller sheets are produced, rolled up and transported to the place. They must be subsequently joined to one another and to the sides of the railway line of the bridge, along which they must be installed.

A first possible joint (FIG. 6A) includes a joint of mechanical type, obtained by a positive locking fit, for example male-female, with the edge of one of the sheets 10 provided with a shaped extension 12, for example drop-like, situated along the midline of the joining side, and with a receiving seat 13 being complementary to the shaped extension 12, grooved in the side of the adjacent sheet. The coupling and introduction between the shaped extension 12 and the receiving seat 13 is certainly capable of maintaining the sheets 10 joined one to another assuring also the tightness.

The bottom of the receiving seat 13 could be recessed with respect to the profile of the shaped extension 12, which could be flattened in its outermost part, in such a way as to leave a cavity 14, once the coupling has been obtained, aimed at being filled with a hardening and sealing liquid injected in a subsequent moment.

A second possible solution, illustrated in FIG. 6B, includes a recess 15, made along the edges of the sheets to be joined, for example equal to about a third of the thickness of the sheet 10 and situated centred along its midline. When the two sheets 10 are put one beside another, the upper borders 16 which delimit the recesses 15 of the two adjacent sheets are lifted, and a strip 18 of the same material is laid onto the two lower, almost juxtaposed, borders 17. The thickness of the strip 18 corresponds to that of the recesses 15 and its width is such to extend for the most part of the two opposite recesses.

The lower surface of the connecting strip 18 can be pre-glued and covered with a protection film (not shown), which is removed on the application. Also the upper surface can be pre-glued and protected with a film, likewise removed when, in the end, the upper borders 16 of the recesses 15 are released.

The possible interspace 19 that remains between the two borders of the upper recesses 16 can be closed by the introduction of the polymer putty 20, so as to improve and assure the waterproofness.

Another solution, illustrated in FIG. 6C, includes a reduction of the thickness along the borders of the sheets 10 to be joined. In a complementary way, the sheet 10 presents, on one of its sides, a reduction of the thickness and a reduced thickness area 21 with lowering of the upper surface, while the opposite sheet presents a reduction of the thickness and a reduced thickness area 22 with lifting of the lower surface. The reduced thickness areas 21, 22 that extend for some centimetres or few tens of centimetres toward the inside of the relative sheets of rubber 10, are then overlaid on the joint, with the interposition of an adhesive substance 23, recomposing the whole thickness and obtaining the tight join.

Figure 4:
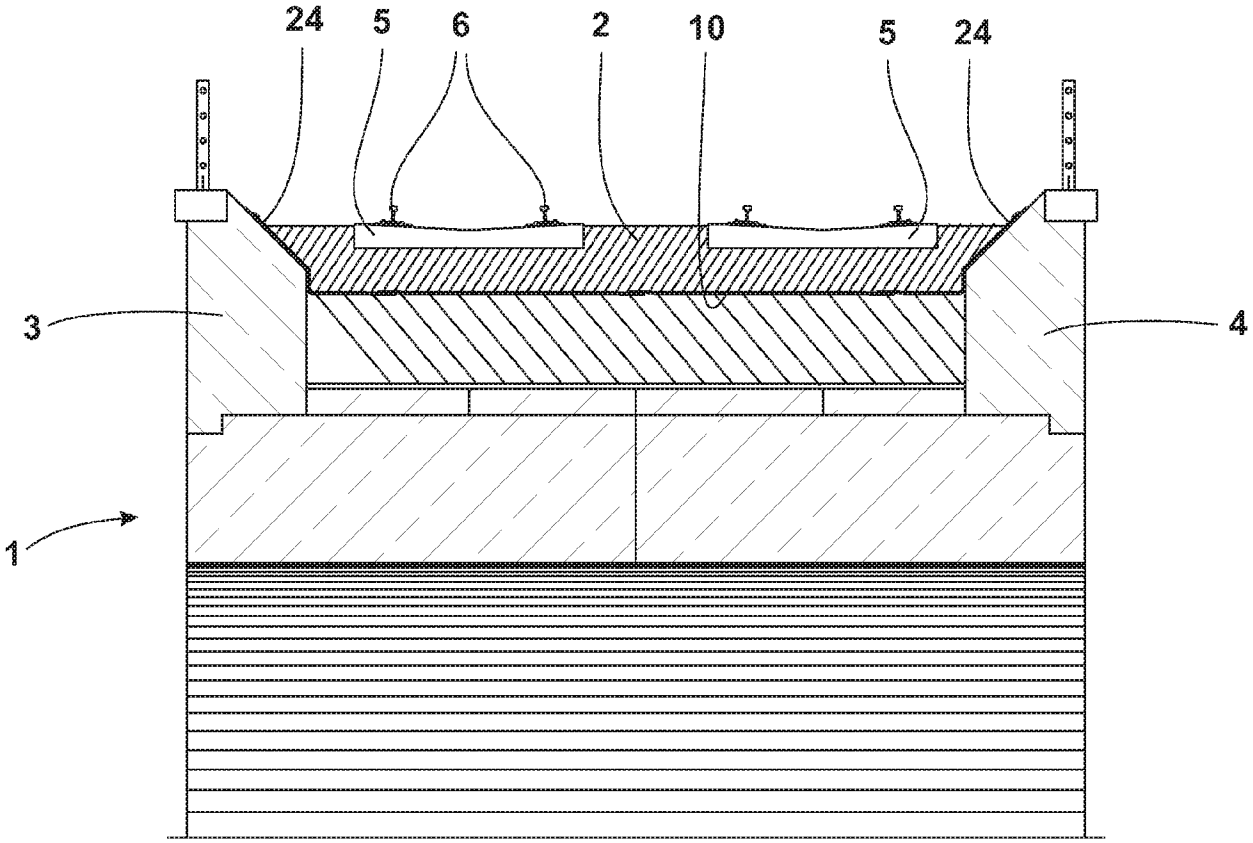
Figure 7B:
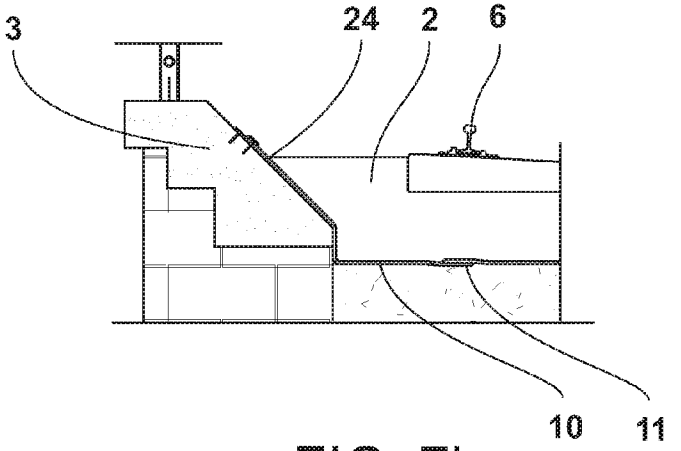
FIGS. 7A to 7D illustrate the details, in section view, of the bridge and waterproofing system according to the invention.

Once the joint between the various sheets of rubber 10 has been realized and the impermeable "carpet" has been obtained, it is necessary to fasten the borders 24 thereof to the containment walls 3, 4 of the ballast 2 (FIGS. 4 and 7B). In order to avoid lateral water infiltrations, the carpet must extend beyond the limits defined for the ballast by the containment walls 3, 4 and vertically or diagonally along the surface of the same walls. The borders 24 of the carpet are fastened to the walls 3, 4 by mechanical means, for example plates (not shown) with through screws driven into the side of the walls.

Figure 8:
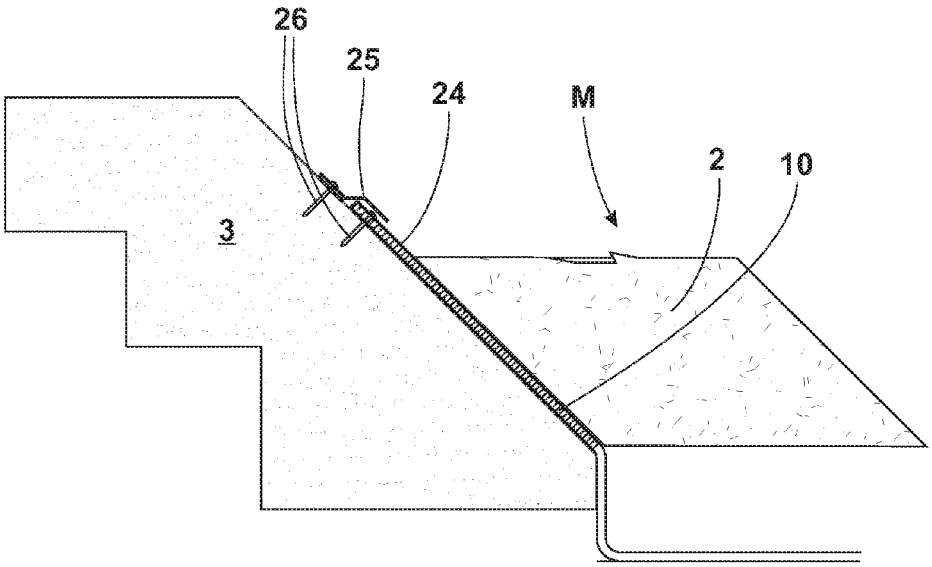
FIG. 8 shows a detail of the system obtained in accordance with the invention.

The tightness between the borders 24 and the walls 3 is usually sufficient to prevent water passage, if there are plates situated over the border of the impervious carpet. In another case, as illustrated in a detailed way in FIG. 8, or if the tightness must be assured, along the borders 24 joined to the walls 3, 4, after the border 24 has been fastened with screws or nails 26, the flashings 25 are applied, likewise fastened for example by screws or nails 26 driven into the wall 3, which rise above the same borders 24, preventing the water passage under them.

Figure 7D:
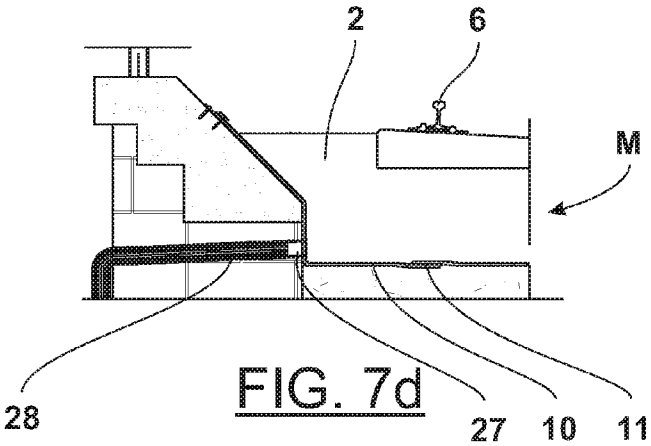
Figure 7A:
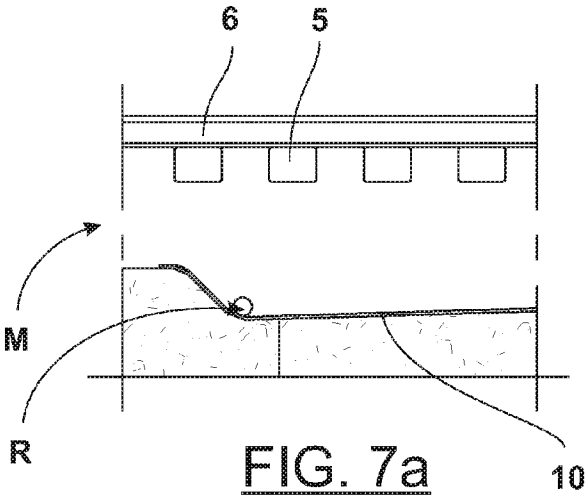
Figure 7C:
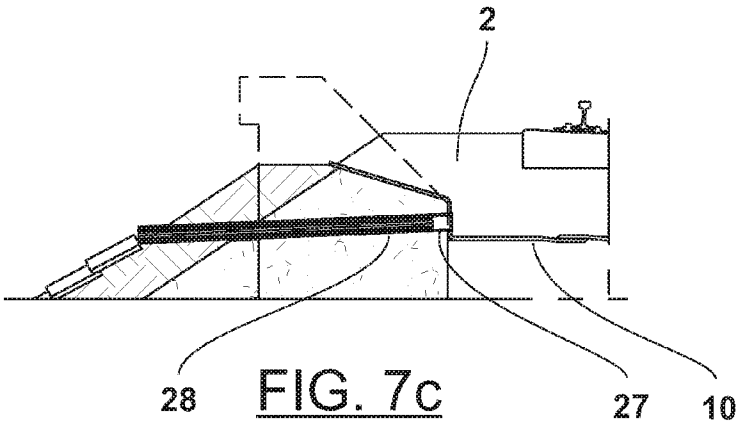

Apart the joint 11 between the various sheets of cured rubber as well as the joint of the impervious carpet with the containment walls 3, 4 of the ballast, it is necessary to provide for required inclinations (FIG. 7A), so that the water is collected in points, from which it can be easily drained later on, in order to avoid useless filling of the "basin" formed by the carpet. As illustrated in FIGS. 7C and 7D, in the collecting points, the water is accumulated and drained by means of inlets 27 tightly joined to the sheets and pipes 28, which originate from the sheets 10 of rubber and empty outside of the ballast M and of the bridge 1.

In the optimal embodiment, the discharge pipes finish in a water removal system (not shown) in accordance with the method that will be obvious for those skilled in the art.

In the bridges with decks the inclination provided for the bridge during construction can be enough. On the other hand, in case of the arch bridges, it is necessary to remove the crushed stone 2 from the ballast to such an extent and with such a distribution as to obtain just an inclined configuration of the surface of the sheets 10 of rubber.

In both cases, a slight inclination toward one or both ends of the bridge 1 can be provided, in such a way as to collect the water in a corner area R of the impermeable carpet, i.e. the area in which the inlets 27 and the water collecting pipes are situated.

A different embodiment of the method according to the invention is illustrated in FIGS. 9A to 9F, and takes up again the most general principle of the invention in the specific case of railway lines or bridges with two or more tracks. The method applicable to a double track line will be described in the following, but it is obvious that it can be advantageously applied to lines or bridges with more parallel tracks.

The railway line or the section of line included in a railway bridge 1, comprises a first track 6*a* and a second track 6*b*, parallel to each other. The method for waterproofing according to the invention includes the following working steps, some of which have common characteristics with the working steps of the method according to the already described embodiment.

Figure 9A:
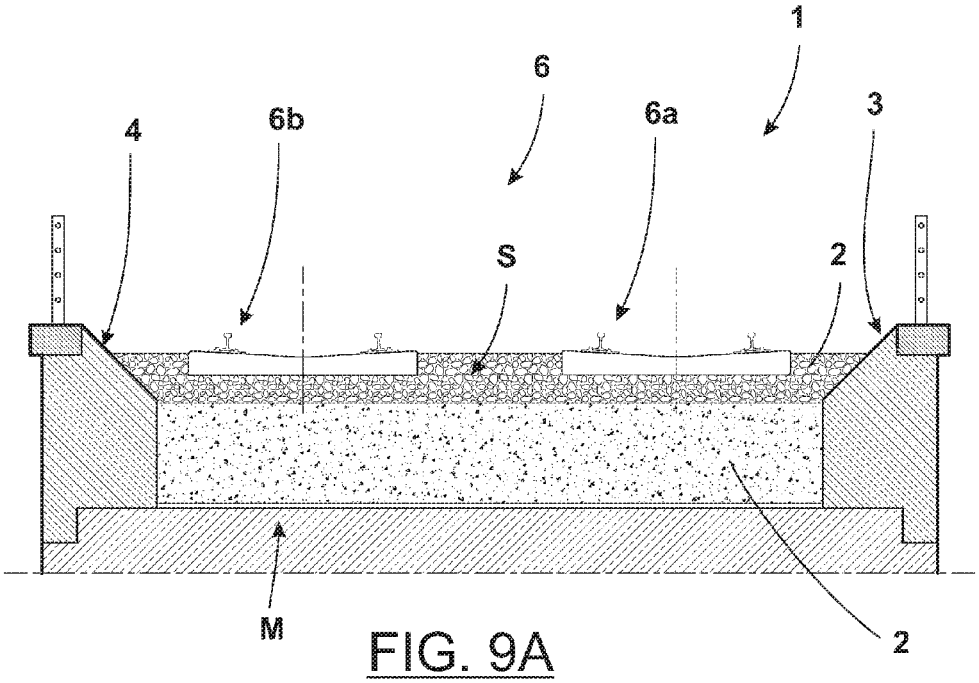
FIGS. 9A to 9F illustrate as many working steps of a different embodiment of the invention, particularly suitable for multi track railway, by which the train traffic must not be interrupted completely.

The beginning situation of the line or bridge 1 is illustrated in FIG. 9A, which points out an upper layer S of the ballast M, whose depth is certainly bigger with respect to the depth of the ordinary maintenance operations, during which a top layer of the crushed stone or gravel 2, that forms the ballast M, is removed and substituted, or even only moved and re-positioned. Usually the depth of the upper layer S, as already defined, is in the range of 50 to 80 centimetres.

In accordance with the method described herein, first of all a piece of the first track 6*a* is removed, together with the ties, in case there are any.

Figure 9B:
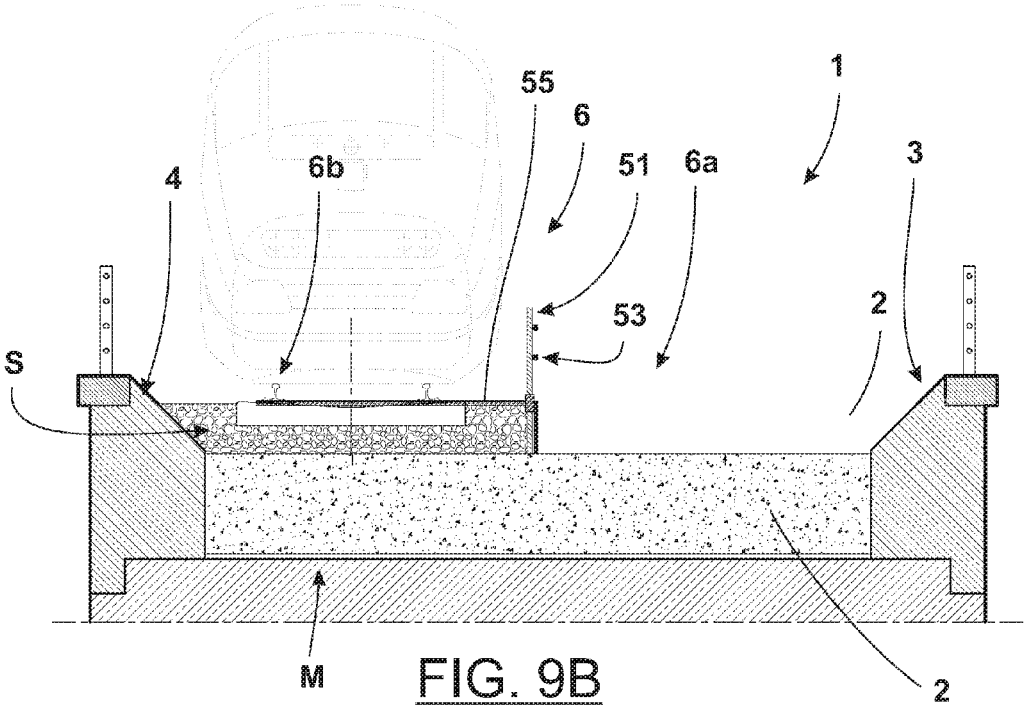

Then, the layer S of gravel or crushed stone 2 that forms the ballast M is made with the normal equipment, provided to the maintenance staff, from the side of the first track 6*a* and little beyond the centreline plane of said ballast M, up to a greater depth with respect to that normally achieved by periodic mixing of said gravel or crushed stone 2 during maintenance operations of the aforementioned tracks 6, thus leaving in place the possible remaining underlying portion of gravel or crushed stone 2 (see FIG. 9B).

After the above described step, in which the upper layer of the ballast from the side of the first track 6*a* is removed (however the operation can be carried out also before), a plurality of first under track crossties 55 are installed below the second track 6*b*.

Then a first vertical shoulder 51 is installed (still FIG. 9B), along the whole extension of the section of line to be waterproofed. The shoulder 51 can be made with wood, metal or another material having suitable mechanical characteristics. The first under track crossties 55 are then fastened to the first shoulder 51. Moreover, a safety rail 53 is fastened to the shoulder 51 in order to protect the site.

Figure 9C:
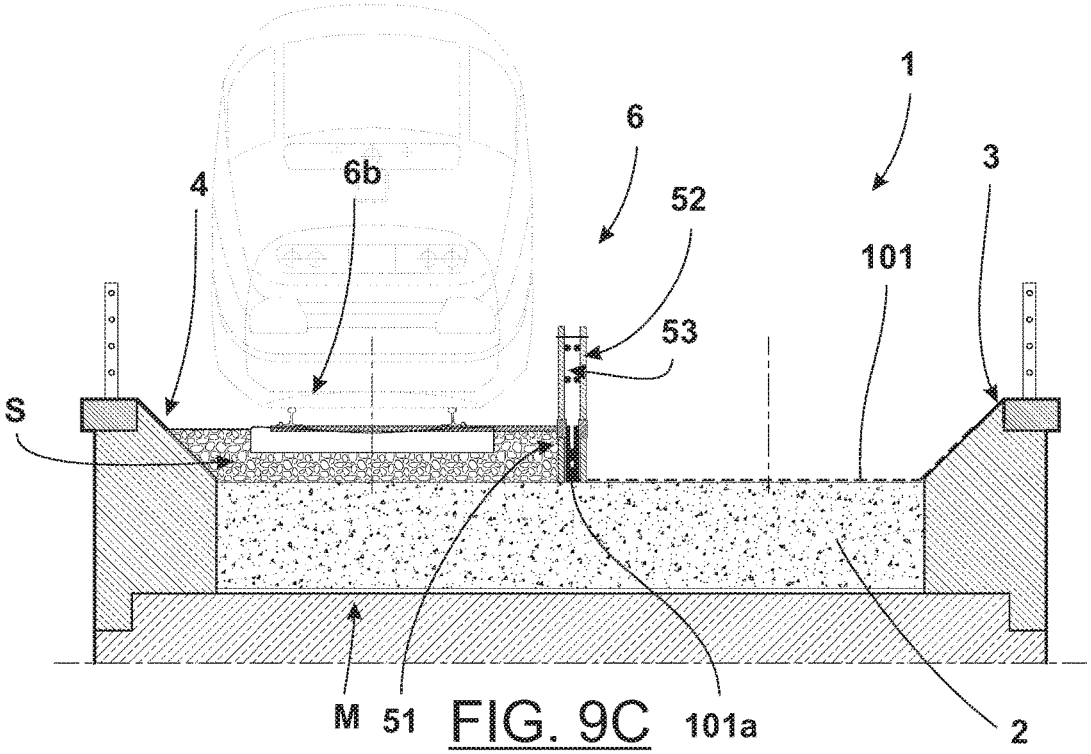
Figure 9D:
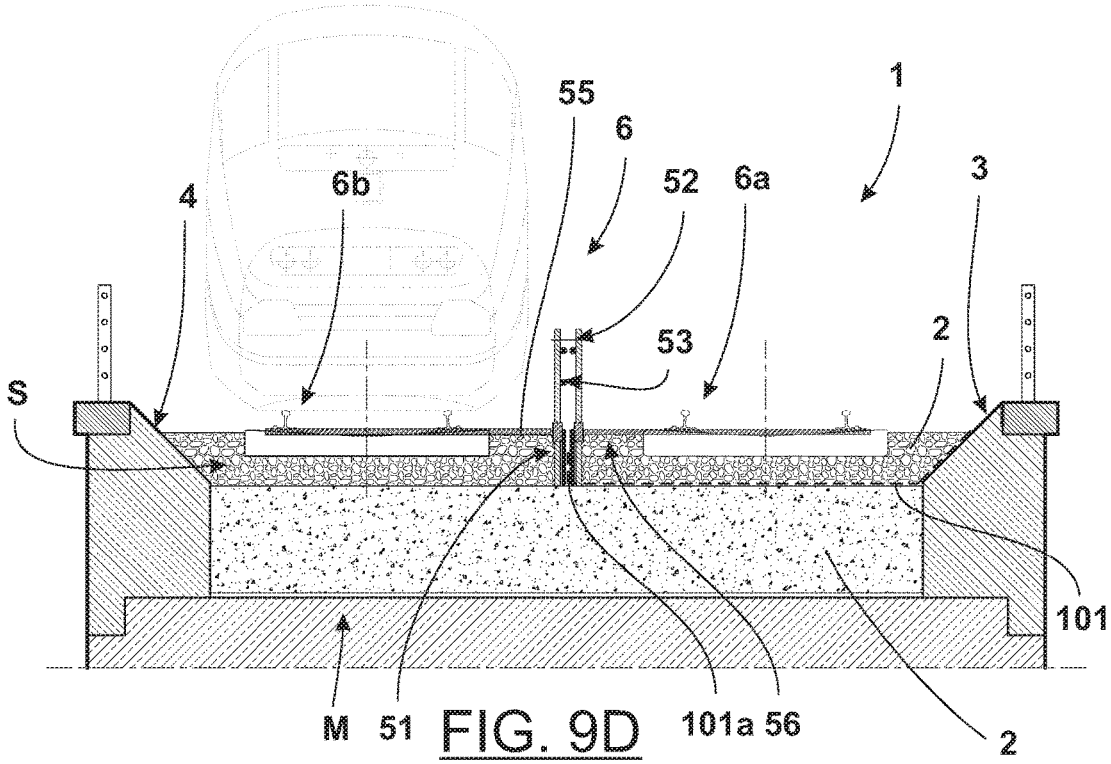

Then a first sheet 101 of cured rubber is spread on the underlying part of gravel or crushed stone 2 of the part of ballast M, from the side of the first track 6*a* (FIG. 9C). Like in the previous embodiment of the invention, the first sheet 101 has a thickness, and in general good mechanical tensile stress, extension and penetration characteristics, such as to be sufficiently resistant, on both faces, to perforation by the gravel or crushed stone 2.

The first sheet 101 is laid while keeping a first edge 101*a* of the above mentioned sheet 101 raised against the wall of the first shoulder 51.

Then, a second vertical shoulder 52 is installed, beside the first shoulder 51, keeping the first edge 101*a* contained between the shoulders first 51 and second 52.

The gravel or crushed stone 2 removed previously, is subsequently repositioned on the first sheet 101 of cured rubber (FIG. 9D); afterwords, the above mentioned first track 6*a* and the possible ties of the previously removed section of railway line are restored.

After or at the same time with the aforesaid step, in which the first track 6*a* is repositioned, a plurality of second under track crossties 56 are installed under the first track 6*a*. The second under track crossties 56 are also fastened to the second shoulder 52 in order to ensure that it remains in position also after the stresses imposed by trains passing on the first track 6*a*.

Figure 9E:
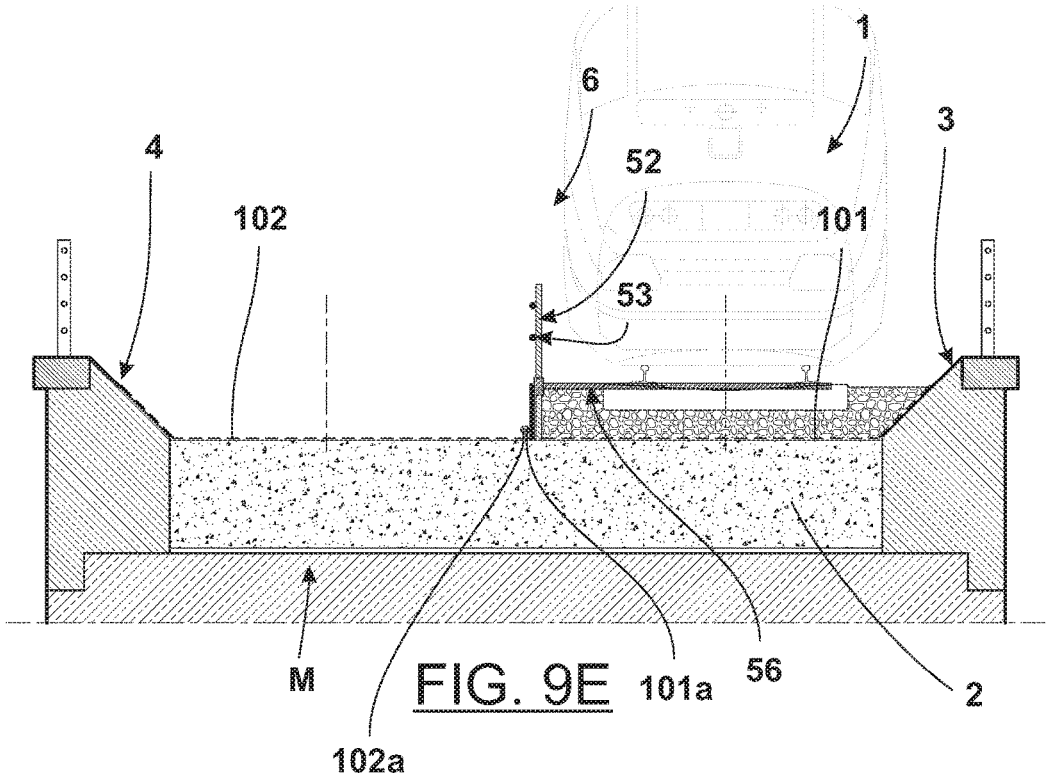
Figure 9F:
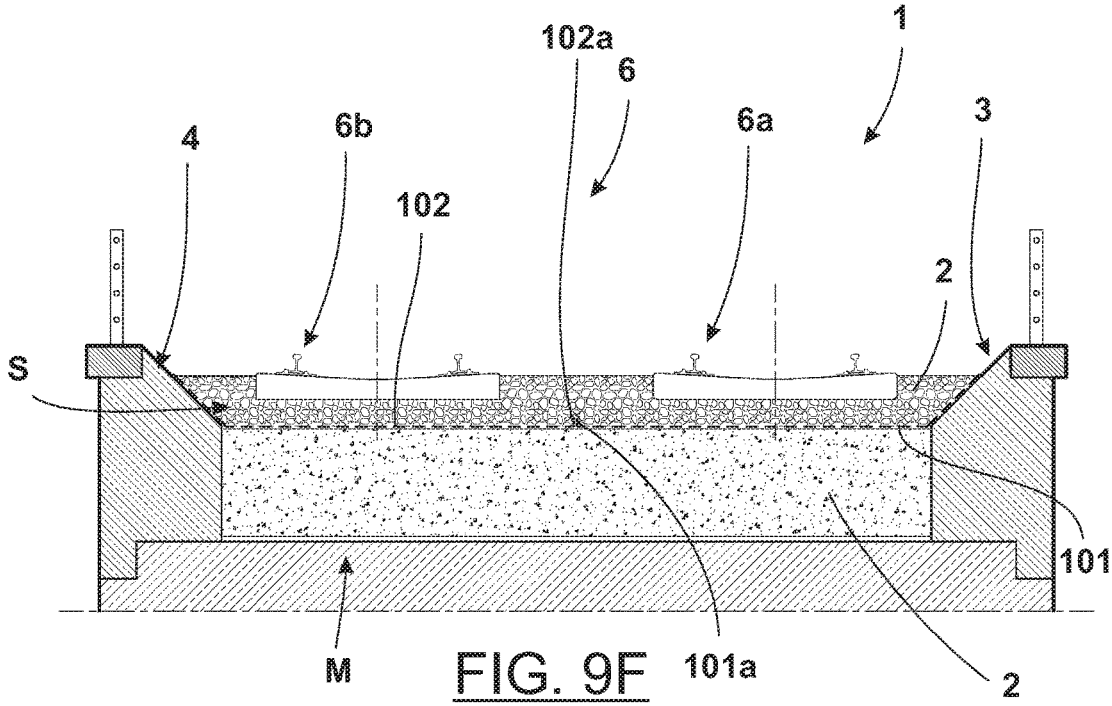

The subsequent step includes removal of a section of said second track 6*b* and of its ties possibly present (FIG. 9E). At the same time, the first under track crossties 55, which at this time have finished their task, are removed.

In accordance with a procedure similar to that already described in relation to the first track 6*a*, a layer S of gravel or crushed stone 2, which constitutes the ballast M, is removed from the side of the second track 6*b*, up to a greater depth with respect to the one normally achieved by periodic mixing of said gravel or crushed stone 2 during the maintenance operations of the aforementioned tracks 6, leaving in place any possible remaining underlying portion of gravel or crushed stone 2.

Then, the first shoulder 51 is removed, leaving only the second shoulder 52 to support the stresses transmitted on the opposite side of the ballast M.

The same way as already described, a second sheet 102 of cured rubber is laid on the underlying part of gravel or crushed stone 2 of the part of the ballast M from the side of said second track 6*b*. The second sheet has the same characteristics as the first sheet 101, and a second edge 102*a* of the second sheet 102 situated beside the first edge 101*a* of the first sheet 101 is kept raised.

The two edges, first 101*a* of the first sheet 101 and second 102*a* of the second sheet 102 are subsequently joined to each other in accordance with one of the above described techniques, or with another known joint technique, in such a way as to make the coupling of the first and second sheets stable and impervious.

The previously removed gravel or crushed stone 2 is subsequently repositioned on the second sheet 102 of cured rubber. Then, the above mentioned second track 6*b* and the ties possibly present of the previously removed section of railway line are repositioned.

Finally, the second under track crossties 56, the second shoulder 52 and the safety rail 53 are removed.

The outer lateral borders of the sheets 101,102 are fastened to the containment walls 3,4 of the line or bridge 1 according to what has been described in relation to the previous embodiment of the method.

At this point, the section of railway line or bridge 1 are perfectly waterproofed and the procedure can be applied to a subsequent section of line or another bridge to be waterproofed.

The above described embodiment of the invention advantageously allows waterproofing operations of the section of line or bridge 1 without the necessity to interrupt completely the traffic on the railway line, thus allowing the trains to transit alternatively on one of the tracks 6*a* or 6*b*, although at reduced speeds.

According to an advantageous version, which has not been illustrated in the enclosed drawings and which can be applied to all the above described embodiments of the invention, the whole extension of the "carpet" of rubber that must be placed in the ballast to restore the waterproofing system, considering a not too long bridge, can be assembled in a suitable seat, thus solving all the complications deriving from the necessity to connect the various sheets. The so obtained carpets can be wound on big rolls, transported to the working site and then applied to the bridge, from which the layer of ballast of the required thickness has been removed.

The obvious advantage of this way of constructing the carpet derives from the considerable reduction of time required for applying the sheath, since the positioning of the sheets 10 and their joint are not necessary. In fact, in this case it is sufficient to spread the sheath, possibly composed of two or more big sheets, if required by the bridge dimensions, and, after the borders have been fastened along the containment walls 3, 4, to place again the crushed stone 2 and tracks.

According to another advantageous version of the covering used for the waterproofing, a fabric or cloth is embedded in the sheets of rubber, in a known way, so as to further increase the resistance of the sheets 10 to tearing and perforation. In this way, the thickness of the sheet can be reduced with respect to that of a sheet 10 constituted only by cured rubber. For example, a total thickness that can be assumed for such covering, can be of about 3-4 millimetres.

Yet more advantageously, in the case of installation on a particularly busy railway line, or with a particularly heavy load traffic, the sheet 10 can be formed by overlaying two suitably stabilized sheets of the aforesaid rubber reinforced with canvas. The stabilization can be obtained by gluing of the two overlaying sheets, or by a subsequent vulcanization.

The thickness of the layer S (FIG. 4) removed for the positioning of the sheets of rubber is only a bit bigger than that of the layer normally removed for the regular ordinary maintenance of the tracks and is typically included between 50 and 80 centimetres. On one hand, the result is the reduction of time necessary for the removal and repositioning of the material, and, on the other hand, the possibility of continuation of the normal maintenance of the railway line without the risk to jeopardize the waterproofing system.

An interesting consequence of the practical application of the present invention is the possibility of reutilization of the material already used and stocked in warehouses. In particular, this is the case of the rubber deriving from the enormous quantity of discarded tyres, which at present remain simply stored in very large areas, perhaps to be partly reutilized in one way or another. The method proposed by the present invention allows a reutilization in massive way of this polluting material, difficult to dispose of, even though it is used as a part of the total quantity of material being used, thus assuming also an ecologic value of primary importance.

Another advantageous effect of the invention derives from the fact that the vibrations transmitted by trains which pass on the bridge to the bridge structure can be reduced. The layer of rubber situated inside the ballast could form a shock absorber which avoids the direct transmission of the vibrations. The beneficial effect on the bridge structure and on the production and diffusion of noise appears obvious.

It is understood that what has been written above is a pure example and is not limiting, therefore possible versions of the method under discussion are considered within the protection field of the invention, as claimed hereinafter.

The invention claimed is:

1. A method for waterproofing of a section of railway line or railway bridge or structure that supports rail traffic on a plurality of tracks (6), including a ballast (M) that includes gravel or crushed stone (2) upon which at least one track (6) extends, with waterproofing (10) placed between the ballast (M) and a support surface of the section of railway line or railway bridge (1) or structure that supports rail traffic, the method comprising:

removing the at least one track of the plurality of tracks (6) of the section of the railway line or railway bridge (1) or structure that supports rail traffic;

removing a layer (S) of gravel or crushed stone (2) forming the ballast (M), up to a greater depth with respect to a depth normally achieved by periodic mixing of said gravel or crushed stone (2), during maintenance operations of the plurality of tracks (6), leaving in place any remaining portion of gravel or crushed stone (2);

laying at least one sheet (10) of cured rubber on the remaining portion of gravel or crushed stone (2) of the ballast (M), said sheet (10) having such a thickness as to be sufficiently resistant to perforation by the gravel or crushed stone (2) situated below, as well as by that which is subsequently placed on top to complete the ballast; and repositioning the previously removed gravel or crushed stone (2) on the at least one sheet of cured rubber (10) and the previously removed at least one track of the plurality of tracks (6) of the section of railway line or railway bridge or structure that supports rail traffic, wherein said section includes a first track (6*a*) and a second track (6*b*), parallel to each other, the method including:

removing a section of said first track (6*a*) and of any associated ties;

removing a layer (S) of gravel or crushed stone (2) forming the ballast (M), from a side of said first track (6*a*) and beyond a midline plane of said ballast (M), up to the greater depth with respect to the one normally achieved by periodic mixing of said gravel or crushed stone (2) during maintenance operations of the plurality of tracks (6), leaving in place any remaining underlying portion of gravel or crushed stone (2);

installing a first vertical shoulder (51), along a whole extension of the section to be waterproofed, laying at least one first sheet (101) of cured rubber on the underlying portion of gravel or crushed stone (2) of the ballast (M), from the side of said first track (6*a*), said first sheet (101) having such a thickness as to be resistant, on both faces, to perforation by the gravel or crushed stone (2), keeping a first edge (101*a*) of said first sheet (101) raised against a wall of said first shoulder (51);

installing a second vertical shoulder (52), situated beside the first shoulder (51), keeping said first edge (101*a*) between said first shoulder (51) and said second shoulder (52);

repositioning the removed gravel or crushed stone (2) on the at least one first sheet of cured rubber (101), of said first track (6*a*) and the associated ties of the previously removed section of the first track (6*a*);

removing a section of said second track (6*b*) and of any associated ties;

removing a layer (S) of gravel or crushed stone (2) forming the ballast (M), from a side of said second track (6*b*), up to the greater depth with respect to the one normally achieved by periodic mixing of said gravel or crushed stone (2) during maintenance operations of the plurality of tracks (6), leaving in place any remaining underlying portion of gravel or crushed stone (2);

removing said first shoulder (51);

laying at least one second sheet (102) of cured rubber on the underlying portion of gravel or crushed stone (2) of the ballast (M), from the side of said second track (6*b*), having a same characteristic type of cured rubber as said first sheet (101), keeping a second edge (102*a*) of said second sheet (102) beside said first edge (101*a*) of said first sheet (101);

joining said first (101*a*) edge and second edge (102*a*);

repositioning the removed gravel or crushed stone (2) on the at least one second sheet of cured rubber (102), of said second track (6*b*) and the associated ties of the previously removed section of railway line; and removing said second shoulder (52).

2. The method as claimed in claim 1, further comprising:

after said removing the layer of gravel or crushed stone forming the ballast (M) from the side of said first track (6*a*), installing a plurality of first under track crossties (55) under said second track (6*b*), and fastening the plurality of first under track crossties to said first shoulder (51);

after or at the same time as said repositioning of said first track (6*a*), installing a plurality of second under track crossties (56) under said first track (6*a*), and fastening the plurality of second under track crossties to said second shoulder (52);

after or at the same time as said removal of said second track (6*b*), removing said first under track crossties (55); and after said repositioning of said second track (6*b*), removing said second under track crossties (56).

3. The method as claimed in claim 1, further comprising:

after said positioning of a first vertical shoulder (51), installing a safety rail (53);

at the same time as said removal of said first shoulder (51) and said second shoulder (52) removing said safety rail (53).

4. The method as claimed in claim 1, wherein external parts of a surface covered by said at least one sheet of rubber (10,101,102) extend from side to side and beyond a limit defined by containment walls (3), (4) of the ballast (M), and in vertical or sloping extension also over the containment walls (3), (4), to define a containment basin.

5. The method according to claim 1, wherein several sheets (10,101,102) are laid out and adjacent sheets of the several sheets (10,101,102) are joined by a bond of mechanical type, obtained by a positive locking fit.

6. A method for waterproofing of a section of railway line or railway bridge or structure that supports rail traffic on a plurality of tracks (6), including a ballast (M) that includes gravel or crushed stone (2) upon which at least one track (6) extends, with waterproofing (10) placed between the ballast (M) and a support surface of the section of railway line or railway bridge (1) or structure that supports rail traffic, the method comprising:

removing the at least one track of the plurality of tracks (6) of the section of the railway line or railway bridge (1) or structure that supports rail traffic;

removing a layer (S) of gravel or crushed stone (2) forming the ballast (M), up to a greater depth with respect to a depth normally achieved by periodic mixing of said gravel or crushed stone (2), during maintenance operations of the plurality of tracks (6), leaving in place any remaining portion of gravel or crushed stone (2);

laying at least one sheet (10) of cured rubber on the remaining portion of gravel or crushed stone (2) of the ballast (M), said sheet (10) having such a thickness as to be sufficiently resistant to perforation by the gravel or crushed stone (2) situated below, as well as by that which is subsequently placed on top to complete the ballast; and repositioning the previously removed gravel or crushed stone (2) on the at least one sheet of cured rubber (10) and the previously removed at least one track of the plurality of tracks (6) of the section of railway line or railway bridge or structure that supports rail traffic, wherein several sheets (10,101,102) are laid out and adjacent sheets of the several sheets (10,101,102) are joined by a bond of mechanical type, obtained by a positive locking fit and wherein the positive locking fit, comprises a male-female type, and includes an edge of one of the adjacent sheets of the several sheets (10, 101,102) being provided with a shaped extension (12) situated along a midline of a junction side (11), and an edge of an adjacent sheet (10,101,102) having a receiving seat (13), matching with the shaped extension (12), the receiving seat (13) configured to receive the shaped extension (12) to obtain said positive locking fit.

7. A method for waterproofing of a section of railway line or railway bridge or structure that supports rail traffic on a plurality of tracks (6), including a ballast (M) that includes gravel or crushed stone (2) upon which at least one track (6) extends, with waterproofing (10) placed between the ballast (M) and a support surface of the section of railway line or railway bridge (1) or structure that supports rail traffic, the method comprising:

removing the at least one track of the plurality of tracks (6) of the section of the railway line or railway bridge (1) or structure that supports rail traffic;

removing a layer (S) of gravel or crushed stone (2) forming the ballast (M), up to a greater depth with respect to a depth normally achieved by periodic mixing of said gravel or crushed stone (2), during maintenance operations of the plurality of tracks (6), leaving in place any remaining portion of gravel or crushed stone (2);

laying at least one sheet (10) of cured rubber on the remaining portion of gravel or crushed stone (2) of the ballast (M), said sheet (10) having such a thickness as to be sufficiently resistant to perforation by the gravel or crushed stone (2) situated below, as well as by that which is subsequently placed on top to complete the ballast; and repositioning the previously removed gravel or crushed stone (2) on the at least one sheet of cured rubber (10) and the previously removed at least one track of the plurality of tracks (6) of the section of railway line or railway bridge or structure that supports rail traffic, wherein several sheets (10,101,102) are laid out and adjacent sheets of the several sheets (10,101,102) are joined by a bond of mechanical type, obtained by a positive locking fit and wherein the adjacent sheets (10,101,102) are joined by a chemical bond, obtained by providing a recess (15) along edges of the sheets (10,101,102) to be joined, by raising upper borders (16) which delimit a recess (15) along each of the adjacent sheets (10,101,102), when said two sheets (10,101,102) are being joined and laying a strip (18) of the same or different material onto a lower border (17) of each recess (15), which are juxtaposed or almost juxtaposed, and by releasing said upper borders (16) so as to obtain said positive locking fit.

8. A method for waterproofing of a section of railway line or railway bridge or structure that supports rail traffic on a plurality of tracks (6), including a ballast (M) that includes gravel or crushed stone (2) upon which at least one track (6) extends, with waterproofing (10) placed between the ballast (M) and a support surface of the section of railway line or railway bridge (1) or structure that supports rail traffic, the method comprising:

removing the at least one track of the plurality of tracks (6) of the section of the railway line or railway bridge (1) or structure that supports rail traffic;

removing a layer (S) of gravel or crushed stone (2) forming the ballast (M), up to a greater depth with respect to a depth normally achieved by periodic mixing of said gravel or crushed stone (2), during maintenance operations of the plurality of tracks (6), leaving in place any remaining portion of gravel or crushed stone (2);

laying at least one sheet (10) of cured rubber on the remaining portion of gravel or crushed stone (2) of the ballast (M), said sheet (10) having such a thickness as to be sufficiently resistant to perforation by the gravel or crushed stone (2) situated below, as well as by that which is subsequently placed on top to complete the ballast; and repositioning the previously removed gravel or crushed stone (2) on the at least one sheet of cured rubber (10) and the previously removed at least one track of the plurality of tracks (6) of the section of railway line or railway bridge or structure that supports rail traffic, wherein several sheets (10,101,102) are laid out and adjacent sheets of the several sheets (10,101,102) are joined by a bond of mechanical type, obtained by a positive locking fit and wherein the adjacent sheets of the several sheets (10,101,102) are joined in complementary reduced thickness areas along borders of the adjacent sheets of the several sheets (10,101,102) by superimposing the reduced thickness areas when joining, with interposition of an adhesive substance (23), so as to obtain said positive locking fit.

9. A method for waterproofing of a section of railway line or railway bridge or structure that supports rail traffic on a plurality of tracks (6), including a ballast (M) that includes gravel or crushed stone (2) upon which at least one track (6) extends, with waterproofing (10) placed between the ballast (M) and a support surface of the section of railway line or railway bridge (1) or structure that supports rail traffic, the method comprising:

removing the at least one track of the plurality of tracks (6) of the section of the railway line or railway bridge (1) or structure that supports rail traffic;

removing a layer (S) of gravel or crushed stone (2) forming the ballast (M), up to a greater depth with respect to a depth normally achieved by periodic mixing of said gravel or crushed stone (2), during maintenance operations of the plurality of tracks (6), leaving in place any remaining portion of gravel or crushed stone (2);

laying at least one sheet (10) of cured rubber on the remaining portion of gravel or crushed stone (2) of the ballast (M), said sheet (10) having such a thickness as to be sufficiently resistant to perforation by the gravel or crushed stone (2) situated below, as well as by that which is subsequently placed on top to complete the ballast; and repositioning the previously removed gravel or crushed stone (2) on the at least one sheet of cured rubber (10) and the previously removed at least one track of the plurality of tracks (6) of the section of railway line or railway bridge or structure that supports rail traffic, wherein external parts of a surface covered by said at least one sheet of rubber (10,101,102) extend from side to side and beyond a limit defined by containment walls (3), (4) of the ballast (M), and in vertical or sloping extension also over the containment walls (3), (4), to define a containment basin, said method further comprising fastening a border (24) of the at least one sheet to a containment wall of the containment walls (3), (4) by means of screws or nails (26) driven into the sides of the containment wall, and providing flashing (25) on the containment wall, in such a way as to rise above edges of the border (24) to prevent passage of water below the border (24).

* * * * *